US005677717A

United States Patent [19]

Ohashi

[11] Patent Number: 5,677,717

[45] Date of Patent: Oct. 14, 1997

[54] INK EJECTING DEVICE HAVING A MULTI-LAYER PROTECTIVE FILM FOR ELECTRODES

[75] Inventor: Yumiko Ohashi, Hashima, Japan

[73] Assignee: Brother Kogyo Kabushiki Kaisha, Nagoya, Japan

[21] Appl. No.: 316,322

[22] Filed: Sep. 30, 1994

[30] Foreign Application Priority Data

Oct. 1, 1993 [JP] Japan ..... 5-246697

[51] Int. Cl.[6] ..... B41J 2/045

[52] U.S. Cl. ..... 347/69; 347/45

[58] Field of Search ..... 347/69, 71, 45, 347/64, 92, 203

[56] References Cited

U.S. PATENT DOCUMENTS

| | | | |
|---|---|---|---|
| 4,450,457 | 5/1984 | Miyauchi et al. | 347/64 |
| 4,879,568 | 11/1989 | Bartky et al. . | |
| 4,887,100 | 12/1989 | Michaelis et al. . | |
| 5,016,028 | 5/1991 | Temple . | |

FOREIGN PATENT DOCUMENTS

| | | | |
|---|---|---|---|
| 2-198852 | 8/1990 | Japan . | |
| 2-279345 | 11/1990 | Japan . | |
| 5-8391 | 7/1991 | Japan . | |
| 5269984 | 3/1992 | Japan | 347/69 |
| 691872 | 4/1994 | Japan | 347/70 |
| WO 89/07752 | 8/1989 | WIPO . | |

OTHER PUBLICATIONS

*Patent Abstracts of Japan*, vol.16 No. 214 (M-1251), May 20, 1992, "Ink Jet Head", Takahiro USUI.

*Patent Abstracts of Japan*, vol. 8 No. 158 (M-311) (1595), Jul. 21, 1984, "Ink Jet Head", Araya YUTAKA.

*Primary Examiner*—Benjamin R. Fuller
*Assistant Examiner*—Charlene Dickens
*Attorney, Agent, or Firm*—Oliff & Berridge

[57] ABSTRACT

To provide an ink ejecting device with high quality and excellent stability, three-layered laminated protective film is formed to cover an electrode which is formed on a ceramic element. The protective film is composed of an organic continuous film formed on the electrode as a first layer for covering surface unevenness. On the resultant smooth surface, a continuous inorganic film is formed as a second layer. Further, an organic layer is formed as a final layer.

8 Claims, 5 Drawing Sheets

INK EJECTING DEVICE HAVING A MULTI-LAYER PROTECTIVE FILM FOR ELECTRODES

BACKGROUND OF THE INVENTION

1. Field of the Invention

The present invention relates to an ink ejecting device having a multi-layer protective film for electrodes. The present invention further relates to a method of producing such an ink ejecting device.

2. Description of the Prior Art

A drop-on-demand type ink ejecting device using a piezoelectric ceramic element has been proposed in the art. With this ink ejecting device, a groove is formed on the piezoelectric ceramic element. The volume of the groove changes when the piezoelectric ceramic material deforms. A droplet of ink is ejected from a nozzle when the volume of the groove decreases and ink is introduced from an ink introduction path when the volume of the groove increases. A plurality of nozzles are aligned adjacent to one another, and ink droplets are selectively ejected from nozzles according to print data. Desired characters and images can therefore be formed on the surface of a sheet confronting the nozzles.

Examples of this type of ink ejecting device are described in Japanese Patent Application Kokai Nos. SHO-63-247051, SHO-63-252750, and HEI-2-150355. FIGS. 1 through 4 are schematic diagrams of conventional examples.

Detailed description of the structure of a conventional ink ejecting device will be provided while referring to FIG. 1. FIG. 1 is a cross-sectional diagram showing an ink ejecting device. A plurality of grooves 12 are formed on a piezoelectric ceramic element 1 in parallel to one another. The piezoelectric ceramic element 1 is polarized in the direction indicated by arrow 4. A cover plate 2, which is made of a ceramic material or a resin material, is bonded to the open surface of the piezoelectric ceramic element 1 with, for example, an epoxy adhesive 3. A plurality of ink channels are thus defined by the cover plate 2 and the grooves 12. The grooves 12 are in turn defined by side walls and a bottom wall of the piezoelectric ceramic element 1. The ink channels have a rectangular cross-section and an elongated structure. Side walls 11 extend along the complete length of the ink channels. Metal electrodes 13 for applying a drive voltage to each ink channel are attached to the upper portion of each of the two side walls. A protective layer 20 is formed over the electrode 13. Ink fills the interior of all the ink channels.

Next, operation of the conventional ink ejecting device will be described while referring to FIG. 2. FIG. 2 is a cross-sectional diagram of the conventional ink ejecting device. In the illustrated ink ejecting device, when groove 12*b*, for example, is identified by the print data, a positive drive voltage is applied to the metal electrodes 13*e* and 13*f* and metal electrodes 13*d* and 13*g* are grounded. This causes an electric field to develop in side wall 11*b* in the direction indicated by arrow 14*b* and also an electric field to develop in side wall 11*c* in the direction indicated by arrow 14*c*. Because the electric field directions 14*b* and 14*c* are perpendicular to the polarization direction 4 of the piezoelectric ceramic element, the side walls 11*b* and 11*c* deform toward the interior of the groove 12*b* due to the piezoelectric shear mode effect. As a result of this deformation, the volume of the groove 12*b* decreases and the pressure in the ink increases. A pressure wave is generated that ejects an ink droplet from the associated nozzle 32 (see FIG. 3) which is in communication with the groove 12*b*. The application of the drive voltage is gradually ceased so that the ink pressure in the groove 12*b* gradually decreases because the ink side walls 11*b* and 11*c* revert to their conditions prior to deformation. Ink is therefore supplied from an ink supply port 21 (see FIG. 3) to the interior of the groove 12*b* via the manifold 22 (see FIG. 3).

Although in the above description, drive voltages are applied so that supply of ink into the groove takes place after the ejection of the ink droplet, the application of the drive voltages to the respective metal electrodes may be reversed so that supply of ink into the groove precedes the ejection of the ink droplet. More specifically, a positive drive voltage is applied to the metal electrodes 13*d* and 13*g* and metal electrodes 13*e* and 13*f* are grounded. This causes an electric field to develop in side wall 11*b* in the direction opposite to the direction indicated by arrow 14*b* and also an electric field to develop in side wall 11*c* in the direction opposite to the direction indicated by arrow 14*c*. Thus, the side walls 11*b* and 11*c* outwardly deform to increase the volume of the groove 12*b* and to decrease the pressure of ink. As a result, ink is initially supplied from the ink supply port 21 to the interior of the groove 12*b* via the manifold 22. The application of the drive voltage is abruptly ceased to allow the ink side walls 11*b* and 11*c* to abruptly revert to their conditions prior to deformation, so that the ink pressure in the groove 12*b* abruptly increases and ink droplet is ejected from the associated nozzle 32.

Next, the structure and method of producing a conventional ink ejecting device will be described while referring to FIG. 3. FIG. 3 is a perspective diagram showing an ink ejecting device. Grooves 12 are cut in the piezoelectric ceramic element 1 with, for example, a thin disk-shaped diamond plate. The grooves 12 are cut in parallel with each other. The grooves 12 are cut to the same depth up to near the end surface 15 of the piezoelectric ceramic element 1, where the grooves 12 are cut gradually shallower with growing proximity to the end surface 15. The portion of each groove 12 nearest the end surface 15 is cut into a shallow groove portion 16. The shallow groove portions 16 are also cut in parallel with each other. The metal electrodes 13 are formed on the inner upper surfaces of the grooves 12 on the side walls by well known techniques, such as sputtering. The metal conductors 13 are also formed to the floor of each groove 12 at the shallow groove portion 16. A protective film 20 is formed to the inner surface of the grooves to cover the metal electrodes 13 using wet or dry film forming techniques.

The cover plate 2 is formed from a ceramic material or a resin material. An ink supply port 21 and a manifold 22 are ground or cut into the cover plate 2. The surface of the piezoelectric ceramic element 1 with the grooves 12 formed therein is adhered using, for example, an epoxy adhesive to the surface of the cover plate 2 with the manifold formed therein. Nozzles 32 are formed in a nozzle plate 31 at positions thereof corresponding to the positions of grooves 12. Next, the nozzle plate 31 is adhered to the end of the cover plate 2 and the piezoelectric ceramic element 1. A substrate 41 is provided with conductor layer patterns 42 at positions corresponding to the grooves 12. The substrate 41 is adhered using, for example, an epoxy adhesive to the surface of the piezoelectric ceramic element 1 opposite from the surface in which the grooves 12 are formed. Conductor wires 43 are wire bonded between the conductor layer patterns 42 and respective metal electrodes 13 formed to the floor of each groove 12 at the shallow groove portion 16 of each groove 12.

Next, the structure of the control portion of the conventional ink ejecting device will be described while referring to FIG. 4. FIG. 4 is a block diagram showing the control portion. Each conductor layer pattern 42 formed on the substrate 41 is connected to an LSI chip 51. A clock line 52, a data line 53, a voltage line 54, and ground line 55 are also connected to the LSI chip 51. A clock pulse is continuously supplied to the LSI chip 51 from the clock line 52. The LSI chip 51 determines the nozzle from which an ink droplet is to be ejected based on data appearing at the data line 53 and clock pulses supplied through the clock line 52. The LSI chip 51 applies a voltage V on the voltage line 54 to the relevant conductive layer connected to the metal electrode 13 at the groove 12 to be driven. Also, a 0 V on the ground line 55 is applied to conductive layers 42 connected to metal electrodes 13 other than those formed in groove 12.

In an ink ejecting device with the above-described structure, the protective film 20 is provided for ensuring that electrodes 13 are electrically insulated and for protecting the electrode 13 itself from corrosion. Conventionally, the protective films 20 are formed from non-reactive, passive state materials, such as alternating layers of silicon nitride (SiNx) and silicon oxinitride (SiON), or films formed from organic materials such as polymide, epoxy, phenol, and the like.

The surface of the piezoelectric ceramic element has irregularities which translates into irregularities in the metal electrode formed thereon. The irregularities in the surface of the metal electrode form shadows during film formation so that the protective film can not be formed in shadowed areas. Therefore, the protective film can not completely protect the electrode. During drive of the ink ejecting device, a voltage is applied to the electrode. The current that flows through the electrode with application of the voltage corrodes exposed areas of the electrode. Corrosion can proceed to the point where ejection is impossible. Water content in the ink can further hasten the corrosion process. Although a protective film formed from only an organic material can effectively cover all the irregularities in the surface of the electrode, organic films absorb water from the air, and hold the moisture as microwater in the film. The moisture in the organic film can contact the electrode and induce corrosion. Moreover, the dielectric strength of organic film is weaker by two orders of magnitude than that of inorganic film. In addition, when the ink ejecting device is used for a long period of time, organic films are easily damaged caused by external stimulation imparted thereto and deterioration caused by aging. At worst, short circuits can occur between channels, so that ejection becomes impossible.

SUMMARY OF THE INVENTION

It is an object of the present invention to overcome the above-described problems and provide an ink ejecting device capable of performing stable and high quality printing by the electrode being completely protected.

In order to achieve these objectives, in the present invention a multi-layer protective film, formed from three or more layers, is provided for protecting the electrode. The first and final layers of the multi-layer protective film are formed from organic protective films. At least one intermediate layer is formed from an inorganic protective film.

In the present invention, the first layer is an organic protective film which covers irregularities in the surface of the ceramic element and electrode. An inorganic protective film is continuously formed directly or indirectly on the resultant smooth surface, thereby increasing effectiveness of insulation and protecting the electrode from moisture. Forming a further organic film as a final layer absorbs stress generated between the organic and inorganic films of the underlying compound film.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Next, a preferred embodiment of the present invention will be described while referring to the accompanying drawings. The basic structure of the ink ejecting device according to the present embodiment is the same as that of the conventional device shown in FIGS. 1 through 4, so the structure of the ink ejecting device according to the present embodiment will be omitted.

In the present embodiment, the ceramic substrate is formed from a lead zirconate titanate (PZT) piezoelectric ceramic element. The grooves are formed through machining process, whereby particles of the PZT material suffer from grain boundary fracture and transgranular fracture. Surface roughness Ra of about 3 is generally observed in the side wall surface of the machined groove. Such irregularities and teeth marks from the cutting blade contributes to poor smoothness of the groove side wall surface. A metal electrode 13 formed on the side wall of such a ceramic substrate 1 takes on the similar irregularities of the underlying ceramic layer, although the extent to the irregularities for the metal electrode 13 depends on the formation method.

To form a protective film 20 for this type of electrode 13, an epoxy resin is firstly spin coated completely over the side and top surfaces of the walls defining the grooves. The epoxy resin is then cured to form an unbroken organic film as a first layer. Irregularities, occurring in the ceramics substrate as describe above, are successfully buried by selecting the viscosity of the coating solvent of the epoxy resin, the type of hardener, the rotation speed, the curing temperature, and the like. The resultant organic film has a continuous smooth surface with gentle undulations. The following is a more detailed description of a method for forming the first layer. A ceramic substrate 1 is provided with dimensions of 1 mm thickness by 50 mm by 50 mm. A plurality of grooves are formed through machining process in the ceramic substrate 1. The ceramic substrate 1 is vacuum adsorbed in a spin coater. About 1 g of 377 epoxy (Epoxy Technology Inc., U.S.A) is dripped onto the ceramic substrate 1. The ceramic substrate 1 is spin coated while rotated at 3,000 rpm. The ceramic substrate 1 is baked for one hour in a clean oven at atmospheric pressure and at 150° C. In this way, an organic film of less than 10 μm thickness and having a smooth surface is formed.

Figure 1:
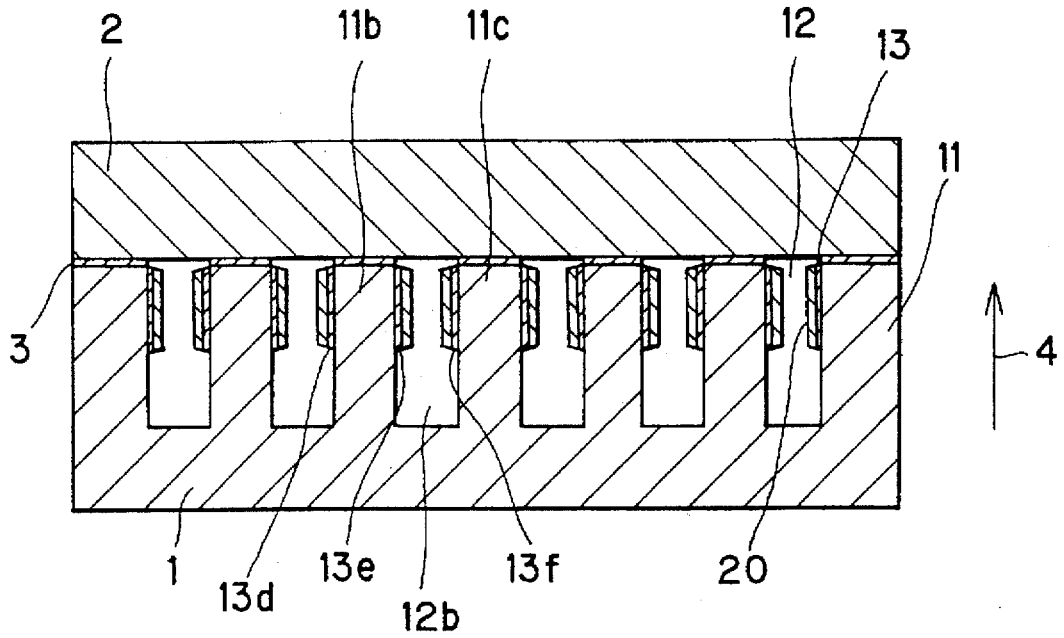
FIG. 1 PRIOR ART
FIG. 1 is a cross-sectional diagram showing a conventional structure of an ink ejecting device.
Figure 2:
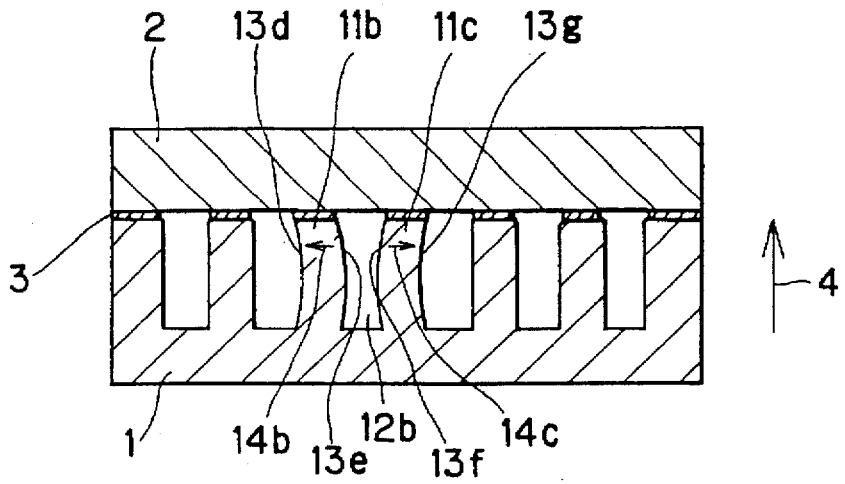
FIG. 2 PRIOR ART
FIG. 2 is a cross-sectional diagram showing a conventional structure of an ink ejecting device for describing an operation of the device.
Figure 3:
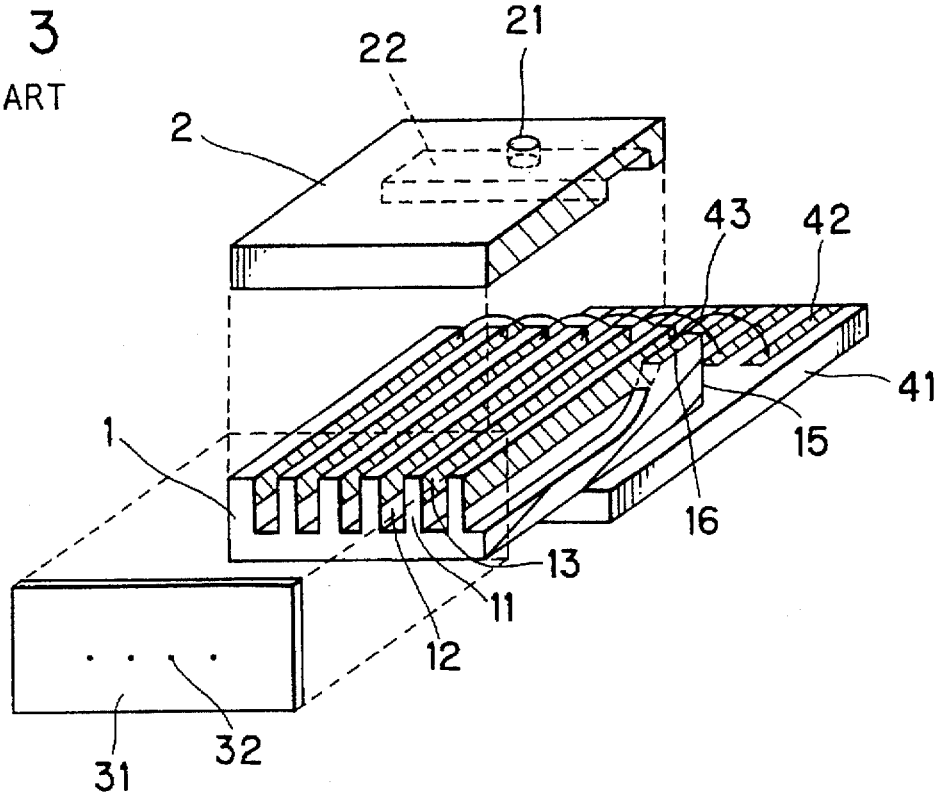
FIG. 3 PRIOR ART
FIG. 3 is a perspective diagram showing a conventional structure of an ink ejecting device.
Figure 4:
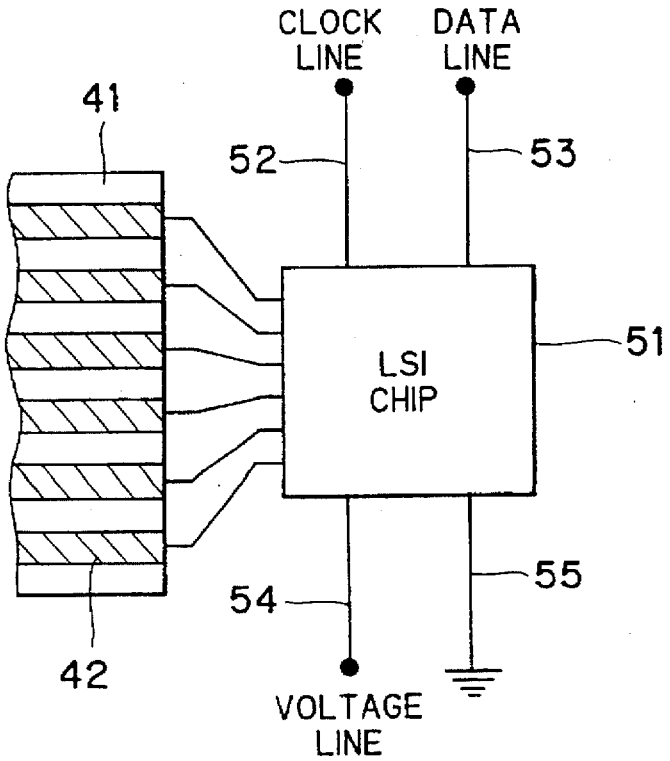
FIG. 4 PRIOR ART
FIG. 4 is a block diagram showing a control portion of a conventional ink ejecting device.
Figure 5:
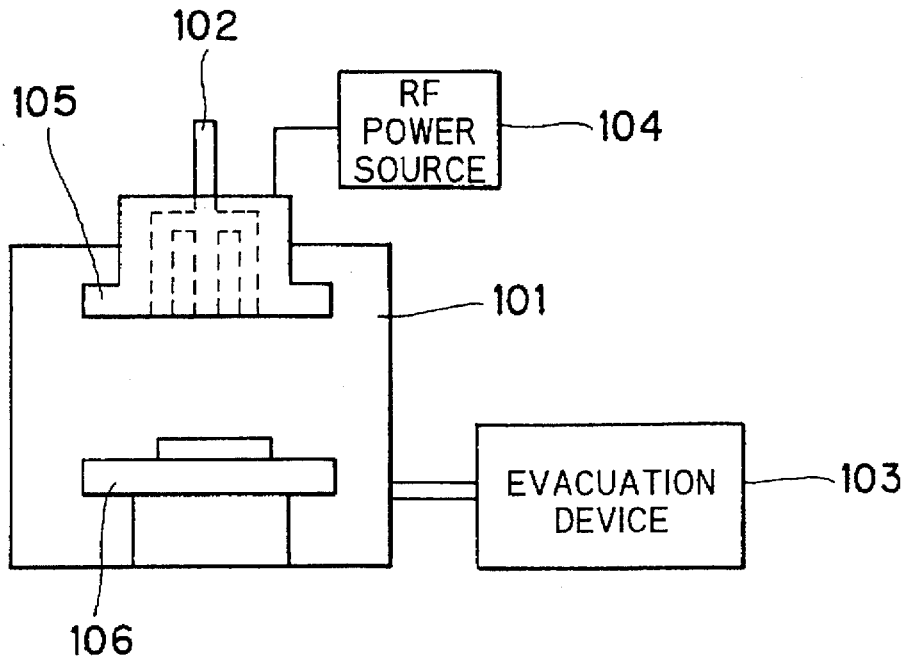
FIG. 5 is a schematic diagram showing a CVD film forming device used in the embodiment of the present invention.

Next, an inorganic film is formed on the organic film using CVD (chemical vapor deposition) or other film forming techniques. As shown in FIG. 5, a CVD film forming device includes a chamber 101, a gas introduction tube 102, an evacuation device 103, and an RF power source 104. A power supply electrode 105 and a sample holder 106 are positioned in the chamber 101 in confrontation and separated by a few centimeters. To form the inorganic film, the piezoelectric ceramic plate 1 is mounted on the sample holder 106 so that the surface of the piezoelectric ceramic plate 1 in which the grooves are formed confronts the power supply electrode 105. The chamber 101 is then evacuated to 2E-7 Torr. Next, material gasses $SiH_4/N_2$, $NH_3$, and $N_2$ are introduced into the chamber 101 from the gas introduction tube 102 at flow rates of 60 sccm, 180 sccm, and 900 sccm, respectively, wherein sccm is a unit of nitrogen converted flow per minute. While the gas is flowing, pressure in the chamber 101 is maintained at 1.2 Torr. 0.8 kW is applied to the power supply electrode 105 to generate a RF discharge, whereupon the material gas becomes an activating reagent for speeding up chemical changes, thereby allowing chemical decompositions and chemical reactions to occur that are normally difficult when using thermal excitation. For example, the non-equilibrium reaction shown in Formula (1) can occur. A 1,000 angstrom thick layer of $SiN_x$ is formed on the substrate over about three minutes of discharge. The thickness of the film can be controlled by the duration of the discharge.

$$3SiH_4+4NH_3 \rightarrow Si_3N_4+12H_2 \quad (1)$$

Because the underlying film is a smooth organic surface, the second film formed in this way can be continuous. Therefore, the inorganic film formed in this way covers the underlying substrate completely. Insulation by this inorganic layer is therefore good. This contrasts with an inorganic film formed directly on the surface of the PZT without an organic film over the underlying surface.

Endurance tests were performed to confirm insulation properties of this inorganic layer. To produce test samples, pieces of ceramic with dimensions 1 mm thick×5 mm×46 mm were machined to form 10 grooves each. Next, metal electrodes were formed to each sample. This was accomplished by tilting each sample at an angle and forming an aluminum (Al) film by vapor deposition to about 1 μm thick on top surfaces and the upper half of each side surfaces of the walls defining the grooves. Each ceramic piece was tilted in the reverse direction so that an aluminum film was formed on both sides of the walls. Next, the aluminum film on the top surfaces of the walls was ground away. The ceramic pieces were cleansed in an organic solvent or the like. Thereafter, the ceramic pieces were dried and baked at 100° C. for 20 minutes. Three types of sample were produced each with a different type of protective layer. In one sample type, the protective layer included only an epoxy organic layer formed by spin coating on the aluminum electrode. A second sample type had a protective film with two layers: an epoxy organic layer as the first layer formed on the aluminum electrode and an $SiN_x$ inorganic film formed on the epoxy organic layer as the second layer. In a third sample type, an $SiN_x$ inorganic film was formed directly onto the electrode without any intermediate epoxy organic film.

Figure 6:
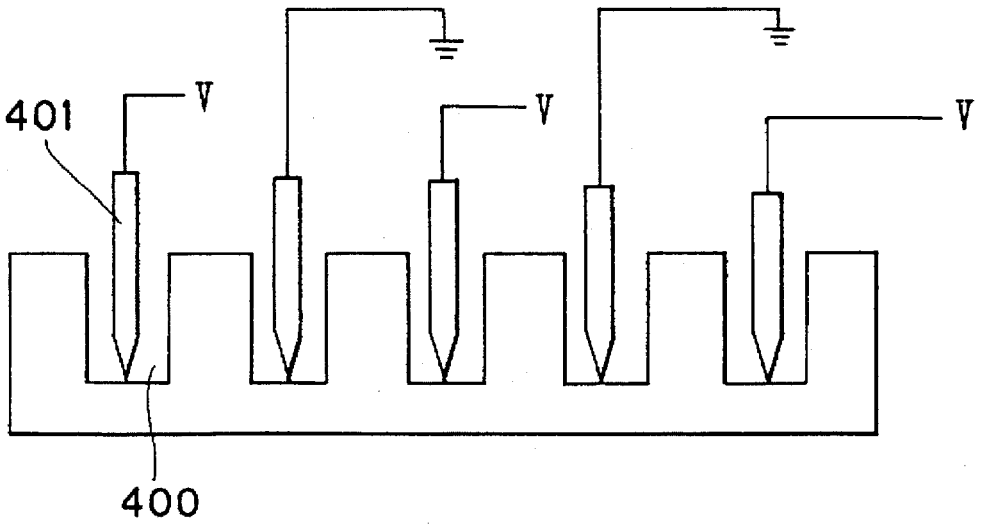
FIG. 6 is a diagram showing the situation of voltage application in endurance tests of the protective film according to the present invention.

Each sample was immersed in a water solution with conductivity of 5.72 mS/cm. As shown in FIG. 6, probes 401 were used to apply a positive voltage to every other of five grooves 400 and to ground the remainder for a duration of 30 minutes. Afterward, the water solution was removed and the resistance of the aluminum electrode measured. The measured resistances were compared with those measured before the samples underwent the endurance trial.

Figure 7A:
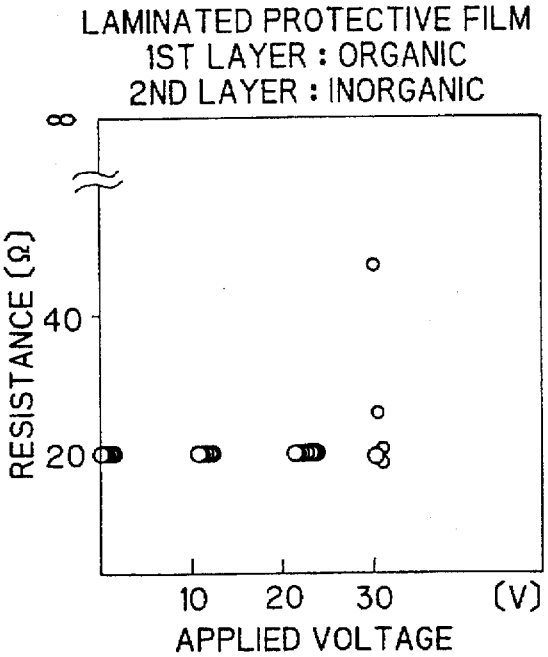
FIGS. 7A–C are graphs showing results of endurance tests of the protective film according to the present invention.
Figure 7B:
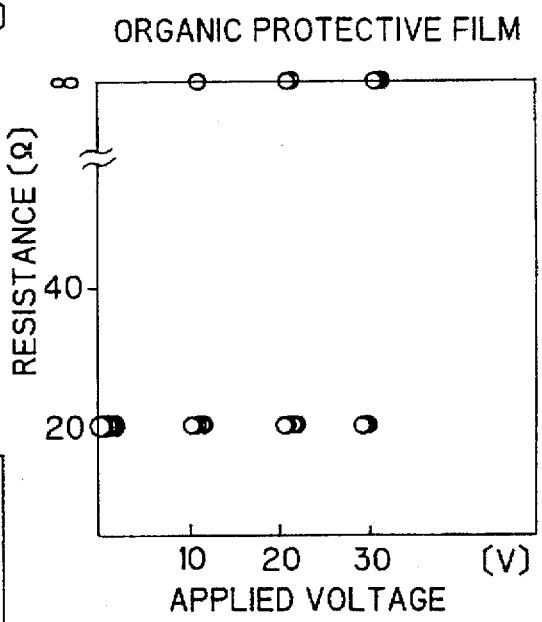
Figure 7C:
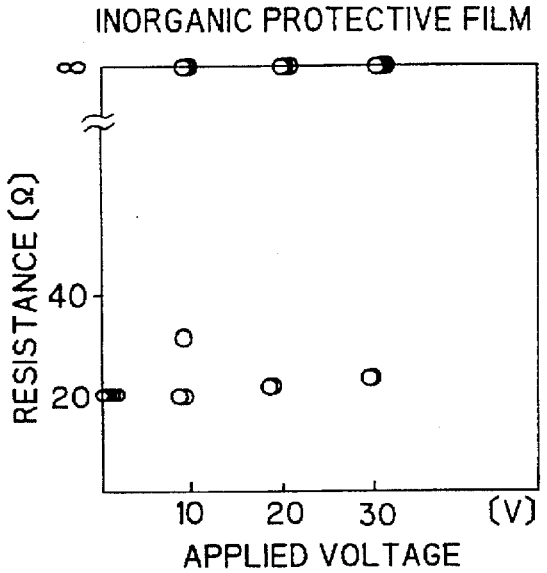

The results of applying 10 V, 20 V, and 30 V are shown in FIGS. 7A through 7C. As can be seen in the graphs, the insulation of the protective film made from an epoxy organic film only, and of the protective film made from an inorganic film formed directly on the electrode, was easily damaged. These protective films were unable to protect the aluminum electrode, and then the aluminum electrode was disconnected from the RF power source 104 so that resistance increased to infinity. In contrast to this, the laminated protective film, formed from an organic layer and an inorganic layer formed on the organic layer, showed hardly any deterioration of the aluminum electrode even when applied with 30 V, which is an actual drive voltage. When water-based ink is used, a voltage of 10 v or greater can not be applied in print heads if the protective films include only either an epoxy organic film or an inorganic film formed directly on the electrode. However, such a print head is not suitable for ink ejection because ejecting ink using a voltage of 10 V or less is extremely difficult. In contrast, by providing a laminated protective film with organic and inorganic films formed in the recited order on the aluminum electrode, a print head can be produced with excellent electrical endurance.

A third or further protective film was formed on the two-layered protective film by spin coating to provide a complete protective film. It was found that a three-layered protective film thus formed provided a head with excellent long-term stability. In the above-described two-layer structure, stress tends to be generated at the border between the films or within the films due to physical differences, such as difference in surface strength and coefficient of linear thermal expansion, between the films of the two layers. External stimuli, such as heat cycles of temperature and humidity, further promote stress so that the protective layer might crack or peel after long term use. A third or further layer of organic film can absorb such stress so that peeling and cracking are prevented.

Endurance tests were performed in the following manner to confirm endurance of such a three-layered protective film. Samples with two layers of the protective film were produced for the endurance test in the same manner as described above. A third layer was formed on the two-layered protective film in five of the sample heads from an epoxy organic film by spin coating. Five other heads were produced with no third layer in the protective film but only the two-layered protective film. Each head was exposed first for eight hours in an environment with 80% humidity and 60° C. temperature and then for eight hours in an environment with normal atmosphere. Each head was repeatedly exposed to these environments for these time durations. The protective film in all five heads with only two layers in the protective layer peeled after only two cycles. Four of the five heads with an organic protective film as a third layer revealed no peeling or cracking when viewed through an optical microscope. In the fifth head having an organic protective film as a third layer, a piece of debris formed a nucleus on which a crack generated so that a portion of the organic film was damaged.

Figure 8:
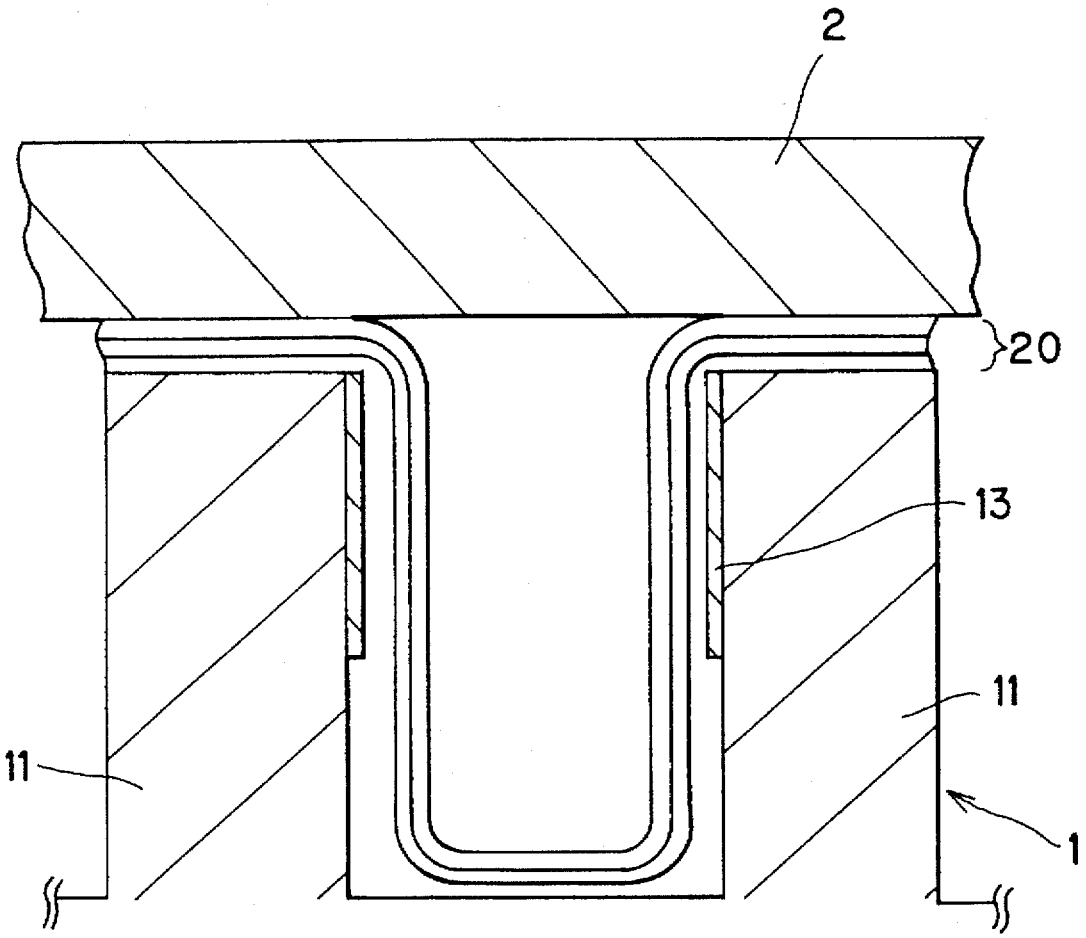
FIG. 8 is a cross-sectional diagram showing a magnified portion of an ink ejecting device according to the present invention.

Therefore, in an ink ejecting device according to the present invention, as shown in FIG. 8, the electrode formed on the side wall 11 of the ceramic element is covered with a protective layer 20. The protective layer 20 is formed from a composite of continuous film layers: an epoxy organic film as the first layer, an inorganic film of $SiN_x$ as the second layer, and an epoxy organic film as the final layer. As described above, this provides a protective film with excellent insulation and waterproof characteristics, and which can endure long-term stress. Further, in the present embodiment, as shown in FIG. 8, the upper surface of the wall 11 is also covered by the continuous protective film 20. The final layer of the protective film 20, that is, the epoxy organic film, can be used to adhere a cover plate 2 to the ceramic substrate 1. To this end, the cover plate 2 is placed on the relevant position on the protective film 20. Then, the epoxy organic film is cured while applying an appropriate pressure to the cover plate 2 toward the protective film 20. Processes for producing the print head can greatly be simplified by the epoxy organic film, which is the final layer of the protective film 20, functioning as an adhesive as well as a means for absorbing stress.

Instead of the epoxy material described in the embodiment, any other material with the above-described properties can be used as an organic film. For example, a silicon resin, a fluoride resin, an aromatic polyamide, a polymer-type polymide, or a phthalic acid resin can be used. Also, a polykishiriren resin and the like can be chemically formed.

The inorganic film can be formed from materials other than the $SiN_x$ materials used in the above-described embodiment. For example, oxides such as oxidized silicon, oxidized vanadium, and oxidized niobium, or compounds of nitride and oxides can be used. Also, the production method is not limited to CVD. Sol-gel techniques, vacuum deposition, sputtering, and other techniques are also available.

Further, although the protective film 20 is described in the present embodiment as being formed from three layers. that is, from an organic layer, an inorganic layer, and another organic layer, a compound or laminated film with four or more layers can be formed. In this case, as viewed from the electrode 13, if the first and last layers are organic films, and the intermediate films are inorganic layers, the same effects as described in the embodiment can be obtained.

As described above, the protective film has a multi-layer structure. The first layer is an organic protective film. The first layer covers irregularities in the surface of the piezoelectric ceramic and the electrode and forms a smooth surface. An inorganic protective film is formed in a continuous film either directly or indirectly on this smooth surface. Insulation effects of the inorganic layer are thereby increased and the electrode is protected from moisture. By further forming an organic protective film as the final layer, stress generated between organic and inorganic films of the compound film is absorbed. Therefore, the electrode can be completely protected under any condition, thus providing an ink ejecting device with high quality.

While the present invention has been described with respect to specific embodiments, it will be understood for a person skilled in the art that various changes and modifications may be made without departing from the scope and spirit of the invention.

What is claimed is:

1. An ink ejecting device, comprising:

a base plate having at least one groove between a pair of partitions, the pair of partitions providing a pair of side walls, and a bottom wall therein;

a cover plate for mounting to an upper surface of said partitions;

a nozzle plate having a nozzle therein, at least a part of said pair of side walls being made from a piezoelectric ceramic element;

an electrode provided for each wall of the pair of side walls, said side walls made from the piezoelectric ceramic element being deformed in response to a voltage applied between said pair of electrodes, causing to eject an ink droplet from said nozzle; and a multi-layer protective film entirely covering each electrode, wherein said multi-layer protective film comprises at least three layers including a first layer directly covering said electrode, a second layer over said first layer and a third layer over said second layer, said first layer and said third layer being made from an organic material, and said second layer being made from an inorganic material.

2. An ink ejecting device according to claim 1, wherein said third layer is formed on the upper surface of each partition of said pair of partitions said upper surface being secured to said cover plate.

3. An ink ejecting device according to claim 1, wherein said first layer is made from a material selected from the group consisting of an epoxy resin, a silicon resin, a fluoride resin, an aromatic polyamide, a polymer-type polymide, a phthalic acid resin and a polykishiriren resin.

4. An ink ejecting device according to claim 3, wherein said second layer is made from a compound of silicon and nitrogen.

5. An ink ejecting device according to claim 3, said second layer is made from a material selected from the group consisting of oxidized silicon, oxidized vanadium, oxidized niobium, and compounds of nitride and oxides.

6. An ink ejecting device according to claim 4, wherein said third layer is made from a material selected from the group consisting of an epoxy resin, a silicon resin, a fluoride resin, an aromatic polyamide, a polymer-type polymide, a phthalic acid resin and a polykishiriren resin.

7. An ink ejecting device according to claim 5, wherein said third layer is made from a material selected from the group consisting of an epoxy resin, a silicone resin, a fluoride resin, an aromatic polyamide, a polymer-type polymide, a phthalic acid resin and a polykishiriren resin.

8. An ink ejecting device, comprising:

at least one ink chamber formed in a piezoelectric ceramic plate by machining, said at least one ink chamber being defined by a pair of side walls and a bottom wall of the piezoelectric ceramic plate, said ink chamber being further defined by a cover plate attached to an upper surface of said pair of side walls of the at least one ink chamber and a nozzle plate having a nozzle therein;

a pair of electrodes attached separately to each wall of said pair of side walls, said pair of side walls being deformed in response to a voltage applied between said pair of electrodes, causing an ink droplet to be ejected from said nozzle; and a multi-layer protective film formed on each electrode of said pair of electrodes to entirely cover said each electrode, wherein said multi-layer protective film is sequentially formed of at least three layers including a first layer formed directly on each said electrode, a second layer formed on said first layer, and a third layer formed on said second layer, said first and third layers being made from an organic material and said second layer being made from an inorganic material.

* * * * *